US008328009B2

(12) United States Patent
Stahl

(10) Patent No.: US 8,328,009 B2
(45) Date of Patent: Dec. 11, 2012

(54) BOTTLE CRATE

(75) Inventor: Edward L. Stahl, Tyler, TX (US)

(73) Assignee: Orbis Canada Limited, Toronto, Ontario (CA)

( * ) Notice: Subject to any disclaimer, the term of this patent is extended or adjusted under 35 U.S.C. 154(b) by 3 days.

(21) Appl. No.: 12/681,344

(22) PCT Filed: Sep. 29, 2008

(86) PCT No.: PCT/US2008/078177

§ 371 (c)(1),
(2), (4) Date: Jul. 7, 2010

(87) PCT Pub. No.: WO2009/043038

PCT Pub. Date: Apr. 2, 2009

(65) Prior Publication Data

US 2010/0288654 A1 Nov. 18, 2010

Related U.S. Application Data

(60) Provisional application No. 60/975,689, filed on Sep. 27, 2007.

(51) Int. Cl.
*B65D 75/00* (2006.01)

(52) U.S. Cl. ..... 206/139; 206/201; 206/486; 211/74

(58) Field of Classification Search ..... 220/218, 220/517, 516, 519; 206/201, 203, 247, 486; 211/74

See application file for complete search history.

(56) References Cited

U.S. PATENT DOCUMENTS

| | | | |
|---|---|---|---|
| D98,200 | S | 1/1936 | Worthington |
| 2,535,493 | A | 12/1950 | Gerber |
| 2,619,251 | A | 11/1952 | Schmidt |
| 2,743,030 | A | 4/1956 | Read, Jr. |
| 2,760,676 | A | 8/1956 | Knieriem et al. |
| 2,970,715 | A | 2/1961 | Kappel et al. |
| 3,092,284 | A | 6/1963 | Stout |
| 3,106,308 | A | 10/1963 | Kazimier |
| 3,151,762 | A | 10/1964 | Vidal |
| 3,247,996 | A | 4/1966 | Garcia |
| 3,326,410 | A | 6/1967 | Asenbauer |
| 3,333,727 | A | 8/1967 | Belcher et al. |
| D208,673 | S | 9/1967 | Adomat |

(Continued)

FOREIGN PATENT DOCUMENTS

| | | |
|---|---|---|
| AU | 247904 | 8/1962 |

(Continued)

OTHER PUBLICATIONS

International Search Report for PCT/US2008/078177 mailed Jan. 12, 2009.

(Continued)

*Primary Examiner* — David Fidei
*Assistant Examiner* — Raven Collins
(74) *Attorney, Agent, or Firm* — Ungaretti & Harris LLP

(57) ABSTRACT

A bottle crate (10) is provided that is configured to hold a plurality of bottles in a generally upright orientation, and is particularly designed to hold bottles having a variable diameter. The bottle crate can include at least one tray and a plurality of fingers (601) elastically arranged on the tray, such that the fingers are configured to move in response to insertion or removal of a bottle.

23 Claims, 10 Drawing Sheets

U.S. PATENT DOCUMENTS

| | | | | |
|---|---|---|---|---|
| 3,347,405 | A | | 10/1967 | Motsenbocker et al. |
| 3,349,943 | A | | 10/1967 | Box |
| 3,361,292 | A | | 1/1968 | Huisman |
| 3,363,802 | A | | 1/1968 | Cornelius |
| 3,376,998 | A | | 4/1968 | Cornelius |
| 3,384,261 | A | | 5/1968 | Austin |
| 3,390,808 | A | | 7/1968 | Rehrig et al. |
| 3,391,814 | A | | 7/1968 | Box |
| 3,391,815 | A | | 7/1968 | Box |
| 3,392,869 | A | | 7/1968 | Box |
| 3,416,694 | A | | 12/1968 | Bebb |
| 3,419,182 | A | | 12/1968 | Gildart |
| 3,506,154 | A | | 4/1970 | Barnes |
| D217,901 | S | | 6/1970 | Rehrig |
| 3,517,852 | A | | 6/1970 | Schoeller |
| 3,565,278 | A | | 2/1971 | Rehrig et al. |
| 3,628,684 | A | | 12/1971 | Sere |
| D229,672 | S | | 12/1973 | Geem |
| 3,791,549 | A | | 2/1974 | Delbrouck et al. |
| 3,812,996 | A | | 5/1974 | Bunnell |
| 3,919,379 | A | | 11/1975 | Smarook |
| 3,997,074 | A | | 12/1976 | Shead |
| 4,101,049 | A | | 7/1978 | Wallace et al. |
| 4,105,117 | A | | 8/1978 | Atkin et al. |
| 4,161,259 | A | | 7/1979 | Palafox |
| 4,162,738 | A | | 7/1979 | Wright |
| D252,961 | S | | 9/1979 | Carroll et al. |
| D254,423 | S | | 3/1980 | Van Geem |
| 4,204,596 | A | | 5/1980 | Davis |
| 4,319,685 | A | | 3/1982 | David |
| 4,410,099 | A | | 10/1983 | deLarosiere |
| D273,523 | S | | 4/1984 | DiSesa |
| D273,524 | S | | 4/1984 | DiSesa |
| D275,142 | S | | 8/1984 | Torokvei |
| 4,538,742 | A | | 9/1985 | Prodel |
| 4,588,087 | A | | 5/1986 | Swingley, Jr. |
| D284,841 | S | | 7/1986 | Rowland et al. |
| D284,898 | S | | 7/1986 | Graham |
| 4,619,371 | A | | 10/1986 | Rehrig |
| D286,936 | S | | 11/1986 | Bitel, Sr. |
| D289,938 | S | | 5/1987 | Warwick |
| 4,700,836 | A | | 10/1987 | Hammett |
| 4,700,837 | A | | 10/1987 | Hammett |
| 4,722,440 | A | | 2/1988 | Johnston |
| 4,759,451 | A | | 7/1988 | Apps |
| 4,773,554 | A | | 9/1988 | Warwick |
| 4,789,063 | A | | 12/1988 | Hammett |
| D302,897 | S | | 8/1989 | Shchamorov et al. |
| D304,123 | S | | 10/1989 | Warwick |
| 4,899,874 | A | | 2/1990 | Apps et al. |
| 4,928,841 | A | | 5/1990 | Arthurs |
| 4,932,532 | A | | 6/1990 | Apps et al. |
| 4,944,400 | A | | 7/1990 | Van Onstein et al. |
| 4,978,002 | A | | 12/1990 | Apps et al. |
| D313,493 | S | | 1/1991 | Apps et al. |
| 5,009,053 | A | | 4/1991 | Langenbeck et al. |
| D317,670 | S | | 6/1991 | Apps |
| D318,552 | S | | 7/1991 | Apps |
| 5,031,761 | A | | 7/1991 | deLarosiere |
| 5,035,326 | A | | 7/1991 | Stahl |
| D319,129 | S | | 8/1991 | Apps et al. |
| 5,038,961 | A | | 8/1991 | Watanabe et al. |
| 5,060,819 | A | | 10/1991 | Apps |
| 5,071,026 | A | | 12/1991 | Apps |
| D325,279 | S | | 4/1992 | Apps |
| 5,105,948 | A | | 4/1992 | Morris et al. |
| D326,346 | S | | 5/1992 | Osakada |
| 5,115,937 | A | | 5/1992 | Chausse et al. |
| D327,357 | S | | 6/1992 | Rehrig |
| D327,970 | S | | 7/1992 | Watanabe et al. |
| D327,972 | S | | 7/1992 | Apps et al. |
| D329,931 | S | | 9/1992 | Apps |
| D329,932 | S | | 9/1992 | Apps |
| D330,621 | S | | 10/1992 | Apps |
| 5,184,748 | A | | 2/1993 | Apps |
| 5,213,211 | A | | 5/1993 | Umiker |
| 5,230,601 | A | | 7/1993 | Apps et al. |
| 5,267,649 | A | | 12/1993 | Apps et al. |
| 5,277,316 | A | | 1/1994 | Apps et al. |
| 5,285,899 | A | | 2/1994 | Apps et al. |
| 5,305,884 | A | | 4/1994 | Apps et al. |
| 5,316,172 | A | | 5/1994 | Apps et al. |
| 5,316,173 | A | * | 5/1994 | Emery ..... 220/556 |
| D348,344 | S | | 6/1994 | Apps |
| 5,323,925 | A | | 6/1994 | Apps |
| 5,335,814 | A | | 8/1994 | Hepp |
| 5,351,814 | A | | 10/1994 | Apps |
| 5,372,257 | A | | 12/1994 | Beauchamp et al. |
| 5,377,862 | A | | 1/1995 | Oakes et al. |
| 5,379,905 | A | | 1/1995 | Bustos et al. |
| D355,764 | S | | 2/1995 | Apps |
| D356,211 | S | | 3/1995 | Apps et al. |
| D356,679 | S | | 3/1995 | Apps |
| 5,405,042 | A | | 4/1995 | Apps et al. |
| 5,426,890 | A | | 6/1995 | Dummen |
| D361,431 | S | | 8/1995 | Koefelda |
| D361,663 | S | | 8/1995 | Kalin |
| 5,445,273 | A | | 8/1995 | Apps |
| 5,465,843 | A | | 11/1995 | Koefelda |
| D365,446 | S | | 12/1995 | Raghunathan |
| 5,487,487 | A | | 1/1996 | Hammett |
| 5,495,945 | A | | 3/1996 | Apps et al. |
| 5,501,352 | A | | 3/1996 | Apps |
| 5,529,176 | A | | 6/1996 | Apps et al. |
| 5,575,390 | A | | 11/1996 | Apps et al. |
| D378,249 | S | | 3/1997 | Apps et al. |
| D379,121 | S | | 5/1997 | Apps et al. |
| D379,717 | S | | 6/1997 | Apps et al. |
| D380,613 | S | | 7/1997 | Apps et al. |
| D380,901 | S | | 7/1997 | Apps et al. |
| 5,651,461 | A | * | 7/1997 | Apps et al. ..... 206/503 |
| 5,660,279 | A | | 8/1997 | Apps et al. |
| 5,704,482 | A | | 1/1998 | Apps et al. |
| 5,752,602 | A | | 5/1998 | Ackermann et al. |
| D395,954 | S | | 7/1998 | Apps et al. |
| 5,785,170 | A | | 7/1998 | Hammett |
| D399,060 | S | | 10/1998 | Apps et al. |
| D399,061 | S | | 10/1998 | Apps et al. |
| D400,012 | S | | 10/1998 | Apps |
| 5,823,376 | A | | 10/1998 | McGrath |
| 5,826,742 | A | | 10/1998 | Timpert |
| D401,764 | S | | 12/1998 | Apps et al. |
| 5,842,572 | A | | 12/1998 | Apps et al. |
| D403,895 | S | | 1/1999 | Beggs |
| 5,855,277 | A | * | 1/1999 | Apps et al. ..... 206/510 |
| D412,399 | S | | 8/1999 | Apps et al. |
| 5,979,654 | A | | 11/1999 | Apps |
| D417,784 | S | | 12/1999 | Umiker |
| 6,006,912 | A | | 12/1999 | McGrath |
| D420,220 | S | | 2/2000 | Apps et al. |
| 6,021,913 | A | | 2/2000 | McGrath |
| 6,047,844 | A | | 4/2000 | McGrath |
| 6,073,793 | A | | 6/2000 | Apps et al. |
| 6,131,730 | A | | 10/2000 | Hsu |
| 6,186,328 | B1 | | 2/2001 | Apps |
| 6,237,758 | B1 | * | 5/2001 | Hsu ..... 206/203 |
| D445,253 | S | | 7/2001 | Hammett |
| D452,613 | S | | 1/2002 | Hammett |
| 6,401,960 | B1 | * | 6/2002 | Hammett ..... 220/516 |
| D461,054 | S | | 8/2002 | Hammett |
| D461,957 | S | | 8/2002 | Hammett |
| D462,522 | S | | 9/2002 | Apps et al. |
| 6,454,120 | B1 | | 9/2002 | Hammett |
| 6,457,599 | B1 | | 10/2002 | Apps et al. |
| D468,634 | S | | 1/2003 | Hammett |
| D469,255 | S | | 1/2003 | Hammett |
| D487,634 | S | | 3/2004 | Apps et al. |
| 6,892,885 | B2 | | 5/2005 | Apps et al. |
| 6,899,247 | B1 | | 5/2005 | Koefelda et al. |
| D507,880 | S | | 8/2005 | Hassell et al. |
| 6,966,442 | B2 | | 11/2005 | Hassell et al. |
| 7,017,746 | B2 | | 3/2006 | Apps |
| 7,036,666 | B2 | | 5/2006 | Hammett |
| 7,086,531 | B2 | | 8/2006 | Apps et al. |
| 7,093,715 | B1 | | 8/2006 | Apps |
| 7,097,033 | B2 | | 8/2006 | Koefelda et al. |
| 7,128,234 | B2 | | 10/2006 | Apps et al. |

| | | | | |
|---|---|---|---|---|
| 7,281,641 | B2 | 10/2007 | Apps | |
| 7,578,410 | B2 | 8/2009 | Stahl et al. | |
| 7,735,676 | B2 * | 6/2010 | Ogburn | 220/516 |
| 2001/0015329 | A1 | 8/2001 | Apps et al. | |
| 2001/0019063 | A1 | 9/2001 | Apps | |
| 2002/0195452 | A1 | 12/2002 | Apps | |
| 2003/0029870 | A1 | 2/2003 | Apps et al. | |
| 2003/0057211 | A1 | 3/2003 | Koefelda et al. | |
| 2003/0075546 | A1 | 4/2003 | Hammett | |
| 2005/0040069 | A1 | 2/2005 | Apps et al. | |
| 2005/0067314 | A1 | 3/2005 | Koefelda et al. | |
| 2007/0095844 | A1 | 5/2007 | Raghunathan | |
| 2007/0246392 | A1 | 10/2007 | Stahl | |
| 2009/0206088 | A1 | 8/2009 | Ogburn | |

FOREIGN PATENT DOCUMENTS

| | | | |
|---|---|---|---|
| CA | 965056 | | 3/1975 |
| CA | 2377480 | A1 | 12/2002 |
| CA | 2669586 | A1 | 12/2009 |
| DE | 1883773 | U | 11/1963 |
| DE | 3801224 | A1 | 4/1989 |
| DE | 10-2004-023044 | A1 | 11/2005 |
| FR | 1518610 | A | 3/1968 |
| GB | 933480 | A | 8/1963 |
| GB | 1032916 | A | 6/1966 |
| WO | 94/11255 | A1 | 5/1994 |

OTHER PUBLICATIONS

International Preliminary Report on Patentability for PCT/US2008/078177 mailed Mar. 30, 2010.

Written Opinion for PCT/US2008/078177 mailed Mar. 27, 2010.

Photographs of bottle crate by Rehrig Pacific Company and located in Mexico.

* cited by examiner

BOTTLE CRATE

CROSS-REFERENCE TO RELATED APPLICATION

This application claims the benefit of application U.S. Provisional Application Ser. No. 60/975,689 filed on Sep. 27, 2007, the disclosure of which is expressly incorporated herein by reference in its entirety.

FIELD OF INVENTION

The present invention relates to a bottle crate for holding a plurality of bottles, and more particularly to a bottle crate including a plurality of elastically arranged fingers for accommodating one or more bottles that have a variable diameter, and holding the bottles securely in an upright orientation.

BACKGROUND OF THE INVENTION

Conventional bottle crates are designed to hold bottles having a substantially constant diameter, or generally straight bottles. For example, conventional 1-liter and 2-liter bottles have a diameter that is substantially the same throughout the barrel of the bottle, not including the top or bottom ends of the bottle. Examples of bottle crates include U.S. Pat. Nos. 6,401,960 and 6,454,120, each of which are incorporated by reference herein.

It would be desirable to provide a bottle crate capable of securely holding bottles in an upright orientation, where the bottles may be contoured or have a variable diameter. The bottle crate described herein and related methods should overcome the deficiencies of the presently available devices and systems.

SUMMARY OF THE INVENTION

A bottle crate is provided that is configured to hold a plurality of bottles in a generally upright orientation, and is particularly arranged to hold bottles having a variable diameter, where the bottle crate preferably includes at least one tray and a plurality of fingers elastically arranged on the tray, such that the fingers can flex or move in response to insertion or removal of a bottle, and the bottles are securely held in the crate. The plurality of fingers, or alternatively, only one finger can be arranged on the tray or crate to secure a bottle.

The plurality of fingers preferably are arranged on wall sections of the at least one tray. Each wall section preferably is supported by a column formed around a bottle receiving pocket. Each of the wall sections can include a plurality of fingers; alternatively, each of the wall sections may include only a single finger.

Each of the fingers may be formed by making cut-outs on the respective wall sections or by forming the fingers with a material with elastic characteristics. Each column supporting a wall section with a plurality of fingers preferably is formed with an cut-out on a top surface of the column to provide additional flexibility.

A method for holding bottles in a bottle crate can include steps of: providing at least one tray configured to receive a plurality of bottles, the at least one tray including a plurality of fingers elastically arranged on the at least one tray; arranging at least one bottle of the plurality of bottles on the bottle crate, such that insertion or removal of the bottle results in movement of at least one of the plurality of fingers; and holding the at least one bottle in an upright orientation in the bottle crate.

A method for holding at least one bottle in a crate can include steps of receiving at least one bottle, the bottle received in a bottle receiving pocket, surrounding each pocket by a plurality of walls, forming a plurality of fingers on each wall, where the fingers are formed to move in response to insertion or removal of the bottle.

A method for holding at least one bottle in a crate can include steps of forming a peripheral wall including a pair of side walls and a pair of end walls, forming a plurality of bottle receiving pockets within the peripheral wall, forming a crate bottom connected to the peripheral wall, forming an upper surface of the crate bottom formed to include a bottle supporting platform for each bottle receiving pocket, forming a plurality of columns having a surface facing into at least one of the bottle receiving pockets; and forming a plurality of fingers on each surface such that each finger elastically impedes a bottle received in the bottle receiving pocket.

The bottle crate of the subject invention is particularly configured to receive bottles of variable diameter, where such a bottle may include a first portion having a large diameter near its bottom and a second portion having a smaller diameter above the first portion. In this case, the step of forming the fingers can include reducing a diameter of a first portion of the bottle receiving pocket that corresponds to the second portion of the bottle. The method for holding at least one bottle can include allowing the second portion of the at least one bottle to pass through the first portion of the bottle receiving pocket, and making contact with the second portion of the at least one bottle.

A bottle crate according to the subject invention can include a plurality of bottle receiving pockets, each of the pockets surrounded by a plurality of walls, where each wall includes a plurality of fingers, and each finger is elastically arranged to move in response to insertion or removal of a bottle. The bottle crate further includes a peripheral wall, the peripheral wall including a pair of side walls and a pair of end walls and a crate bottom connected to the peripheral wall.

The bottle crate can include an upper surface of the crate bottom formed to include a bottle supporting platform for each bottle receiving pocket, where each wall of the plurality of walls is supported by a column having a surface facing into at least one of the bottle receiving pockets.

Each of the fingers preferably is arranged such that a diameter of the bottle receiving pocket is reduced by a predetermined amount such that a bottle having a first portion of a large diameter near its bottom and a second portion of a small diameter above its first portion may be received into the bottle receiving pocket.

Other aspects and embodiments of the invention are discussed below.

BRIEF DESCRIPTION OF THE DRAWINGS

For a fuller understanding of the nature and desired objects of the present invention, reference is made to the following detailed description taken in conjunction with the accompanying drawing figures wherein like reference character denote corresponding parts throughout the several views and wherein.

DEFINITIONS

The instant invention is most clearly understood with reference to the following definitions:

As used in the specification and claims, the singular form "a", "an" and "the" include plural references unless the context clearly dictates otherwise.

As used herein, the term "bottle crate" refers to a crate, container, tray, or any similar display or storage device configured to hold one or more containers such as bottles, cans, or other containers, and is not restricted to a crate for holding bottles, but may include perishable or nonperishable food or other items.

DETAILED DESCRIPTION OF THE INVENTION

A bottle crate is provided that is configured to hold a plurality of bottles in a generally upright orientation, and is particularly arranged to hold bottles having a variable diameter. The bottle crate preferably includes at least one tray, where a plurality of bottle crates or trays are stackable. The bottle crate includes a plurality of elastic or spring elements such as fingers, the fingers extending longitudinally from a generally flat horizontal surface of the at least one tray. The fingers are configured to bend or flex in response to movement of a bottle therethrough. The fingers can be made of any suitable bendable or elastic material, for example, plastics such as polyethylene, and preferably project from a portion of the at least one tray.

The fingers can be arranged on wall sections of the bottle crate, such that the wall sections are arranged closer together than the maximum diameter of a bottle intended to be held by the crate, and such that the fingers will bend to allow movement of a larger diameter portion of the bottle therethrough, while preferably gripping or impeding a smaller diameter portion of the bottle.

For example, if the bottles have a variable diameter, the fingers would tend to flex or move away from the bottle during insertion or removal of a larger diameter portion of the bottle. Otherwise, when a smaller diameter portion of the bottle passes the fingers, the fingers would tend to return to their original, non-flexed state.

Also, the fingers can be arranged on wall sections of a low-profile bottle crate such that the fingers make contact with a bottle received in the crate near a first portion of the bottle having a diameter smaller than a second portion of the bottle having a larger diameter that is located closer to the bottom of the bottle than the first portion of the bottle. In this configuration, the fingers hold the bottle in an upright orientation and impede the bottle from moving out of the bottle crate. By choosing the first portion of the bottle that is nearest the bottom of the bottle, the bottle crate can retain a low profile. Bottle crates having a low-profile generally have the advantage of a lower cost of construction and a lower cost of transportation due to its lesser material required for construction lesser weight.

Figure 1:
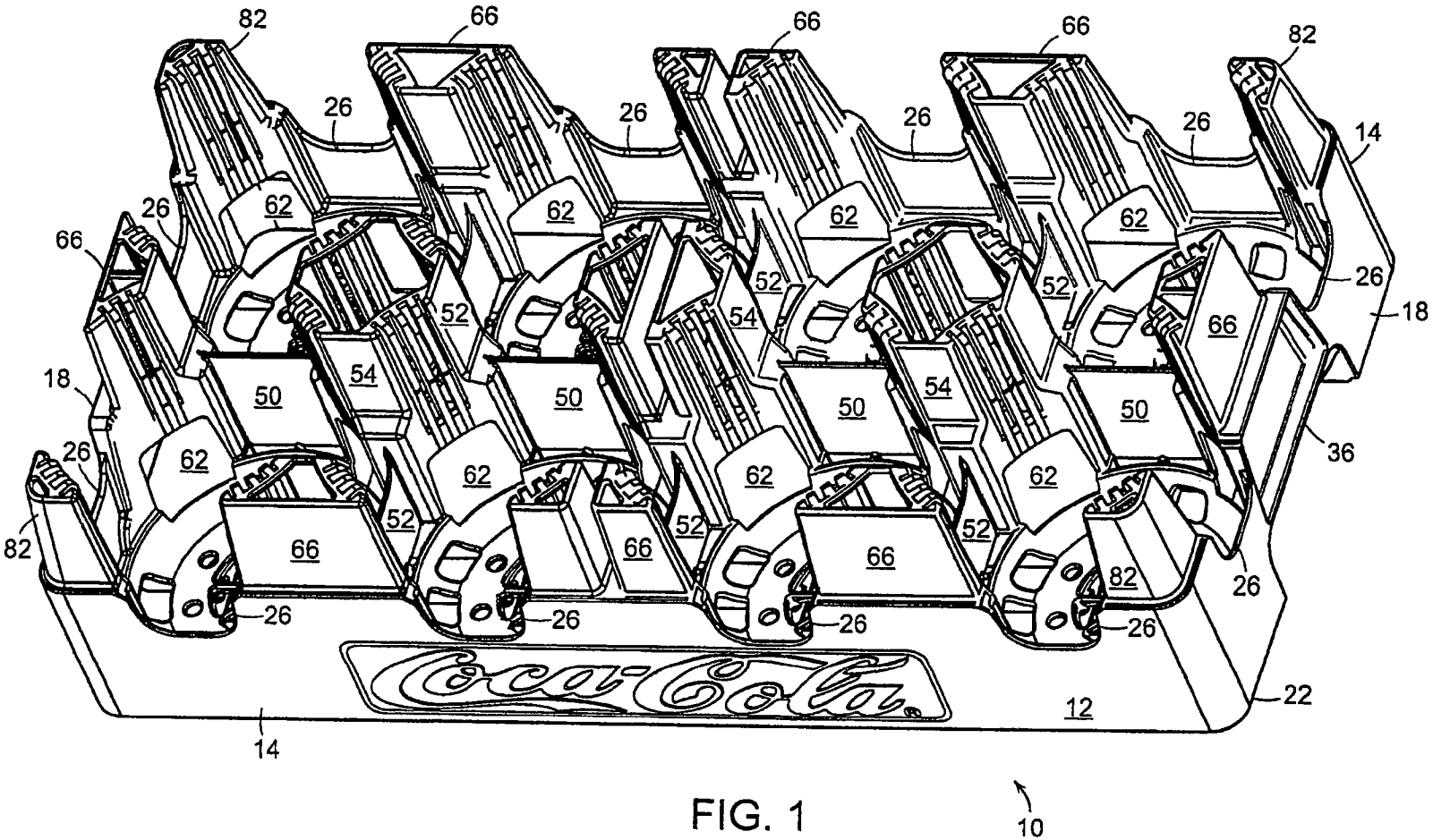
FIG. 1 is a front perspective view of a bottle crate according to the subject invention.

In FIG. 1 and throughout the figures, the fingers can be arranged to grip 2-liter bottles at a height of approximately 4¾" from the bottom of each bottle, or about the middle of a bottle being approximately 10½" in height. These dimensions are provided by way of example, and do not constitute any limitation of the invention. In actual construction and use, the bottle crate may include a plurality of fingers configured to grip any suitable portion of a bottle, where such a portion may have a reduced diameter. For example, the bottles can have a smaller diameter portion in approximately the middle of the bottle, such that the fingers will grip a bottle in approximately the middle of the bottle, and a heel of each bottle is configured to fit within designated areas of a base of the trays. It will be appreciated that the height of the fingers can be arranged so as to approximately fit the particular contour of a bottle. In particular, the height of the fingers can be arranged so as to approximately support a bottle received in the crate at a height where a diameter of the bottle is smaller than a diameter of the bottle near a base of the bottle.

In one preferred embodiment, as shown in FIGS. 1-8C, the bottle crate 10 is configured to hold 2-liter bottles, although other types of bottles or other containers could be held in the bottle crate. The crate 10 preferably has a peripheral wall 12 that includes a pair of side walls 14 and a pair of end walls 18. The peripheral wall 12 preferably is of substantially uniform height, extending from a crate bottom 22 to an intermittent or discontinuous top surface 24 (see FIGS. 2 and 3). As used herein, the top surface 24 also refers to the top surfaces of support columns 54, 66, and 82.

U-shaped cut-outs 26 preferably are spaced about the peripheral wall 12, with four such cut-outs in each of the side walls 14 and two in each of the end walls 18, although in other embodiments more or fewer cut-outs can be provided. For example, approximately 2-8 cut-outs could be provided. The cut-outs 26 reduce the weight of the crate and also provide good visibility to individual bottles in the crate. The cut-outs 26 preferably are centered on individual bottle support platforms 92 formed in the crate bottom (see, e.g., FIG. 7). Each end wall 18 preferably has a centrally located generally rectangular cut-out 36 in the lower portion to create a handle opening 46 that allows a user to grasp and lift the crate at opposite ends. Although U-shaped cut-outs are described herein, other shapes for such cut-outs are encompassed by the subject invention, including cut-outs having a substantially round, square, rectangular, or any other suitable shape. Optionally, the cut-outs can be omitted, and the peripheral wall 12 can be substantially continuous.

Figure 1A:
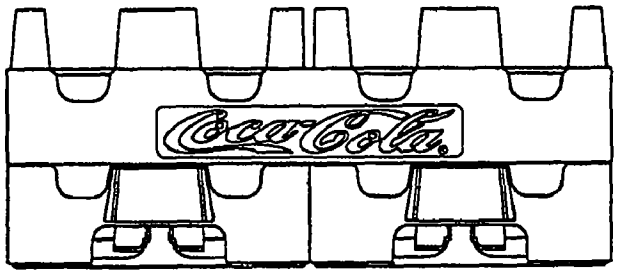
FIG. 1A is an elevation view of four bottle crates stacked in a nesting formation.
Figure 2:
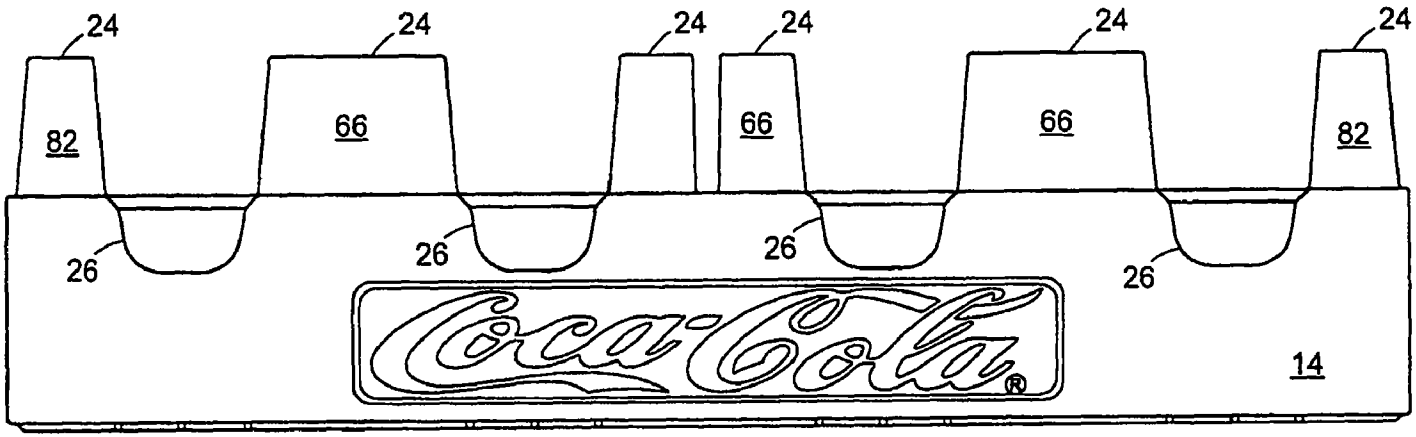
FIG. 2 is a side elevation view of the bottle crate of FIG. 1.
Figure 3:
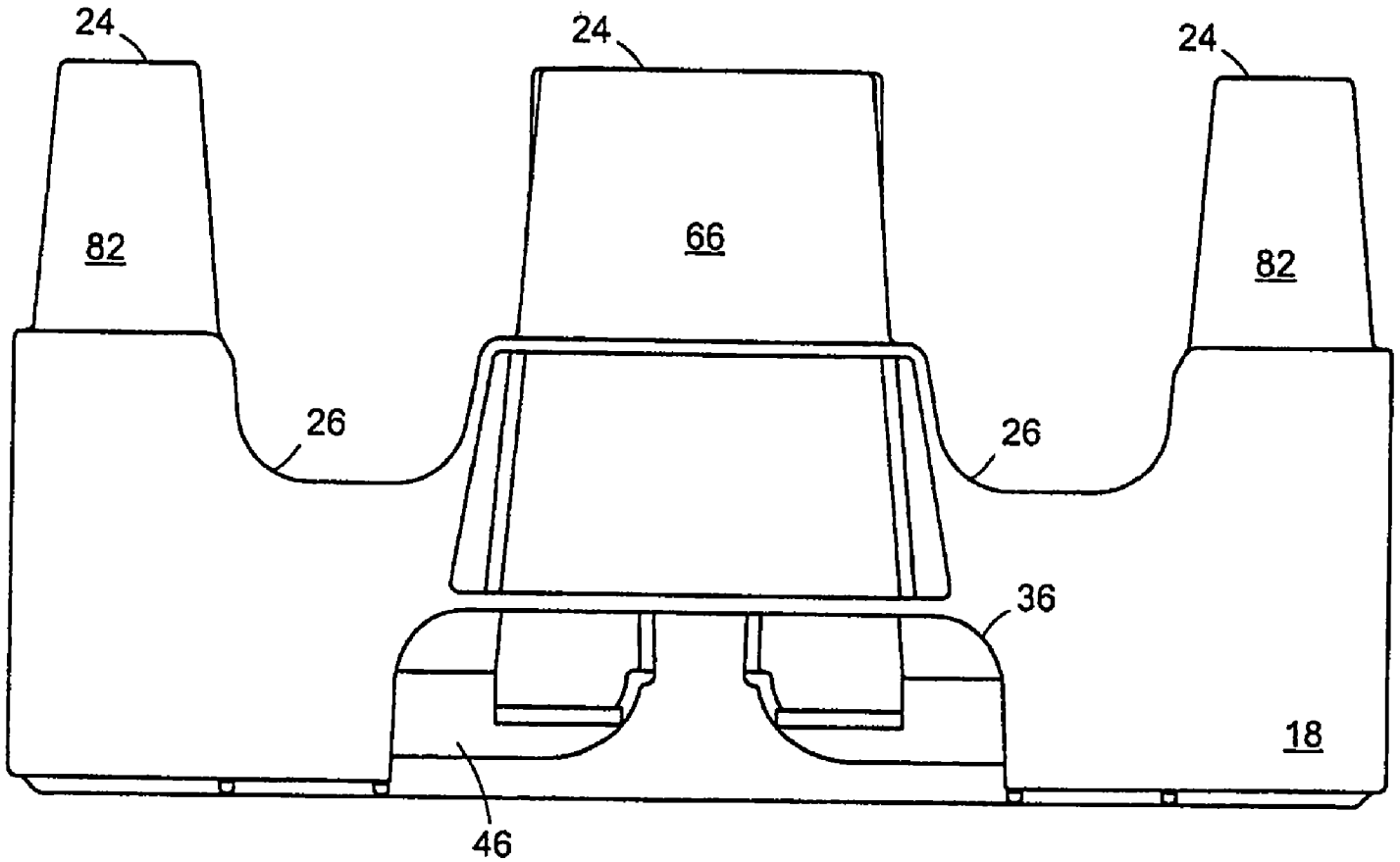
FIG. 3 is a end elevation view of the bottle crate of FIG. 1.

The interior of the crate preferably is divided into one or more rows of bottle receiving pockets. For example, in the embodiment depicted in FIG. 1, the crate is divided into two rows of bottle receiving pockets 48 by a longitudinal partition 50 extending between the end walls 18 along the longitudinal center of the crate, and by transverse partitions 52 extending between the side walls 14, thus establishing four bottle receiving pockets 48 in each of the two rows. The middle transverse partition 52 intersects the longitudinal partition 50 at the longitudinal and transverse center of the crate, although other arrangements of these partitions are possible. A generally octagon-shaped interior column 54 can be formed at each of the three interior intersections of the longitudinal partition 50 with a respective transverse partition 52. Each interior column 54 preferably includes four walls 56 that are perpendicular to the respective intersecting partitions 50, 52 and four walls 58 that face radially towards the center of four adjacent bottle receiving pockets 48. Each wall 58 preferably includes a plurality of fingers elastically arranged to provide bottle supporting surfaces for a bottle received in the respective pockets 48. The interior columns 54 can be substantially hollow, and supported by the partitions 50, 52, and thus extend only a part of the way toward the crate bottom. This configuration can conserve material and provide openings 62 below each column for receiving the columns in an underlying crate when a plurality of similar empty crates are stacked (see FIG. 1A). The empty crates may be stacked in a one-to-one formation (not shown) or a nesting formation, as shown in FIG. 1A, where two crates are stacked on two crates that are rotated 90 degrees such that the top two crates will interlock with the bottom two crates. It will be appreciated that while each bottle receiving pocket 48 is supported by four bottle supporting surfaces, each including a plurality of elastically arranged fingers in this embodiment, the number of supporting surfaces may be increased or decreased according to the number of bottles arranged to be received by the bottle crate.

Along the end walls 18 and side walls 14, partial or half columns 66 (approximating one half of an interior column 54) preferably are formed on the interior of the side walls 14 and end walls 18. The half columns 66 preferably are centered where the transverse partitions 52 intersect the side walls 14, and where the longitudinal partition 50 intersects the end walls 18. Each of the half columns 66 includes walls 56 preferably arranged in a perpendicular manner with respect to respective partitions 52, 50 and angled walls 70 that face radially toward the respective centers of two adjacent bottle receiving pockets 48 (see FIG. 7). These half columns preferably are supported by a partition 52 and side wall 14 or by a partition 50 and end wall 18. The half columns 66 also only extend a part of the way toward the crate bottom, with openings 62 formed therein.

The end wall half columns 66 also extend only a part of the way to the crate bottom 22, with openings 62 framed by the longitudinal partition 50 on one side of the opening and the respective end wall 18 on the other side of the opening. The walls 70 of the side and end wall half columns 66 also include one or more fingers elastically arranged to provide bottle supporting surfaces for a bottle in the respective pockets 48.

Corner columns 82 preferably are formed at the corners of the crate. Each corner column 82 preferably is approximately one quarter in size of an interior column 54 and include a wall 58. Each wall 58 faces radially towards the respective centers of the corner bottle receiving pockets 48 and includes fingers elastically arranged to provide bottle supporting surfaces for a bottle in the respective pockets 48. The corner columns 82 also have lower openings 62 framed by the respective side wall 14 and end wall 18.

Accordingly, each bottle receiving pocket 48 and a bottle received in the bottle receiving pocket 48 preferably will be supported by four walls, each including a plurality of fingers elastically arranged to provide bottle supporting surfaces for a bottle in the respective pocket 48.

Figure 4:
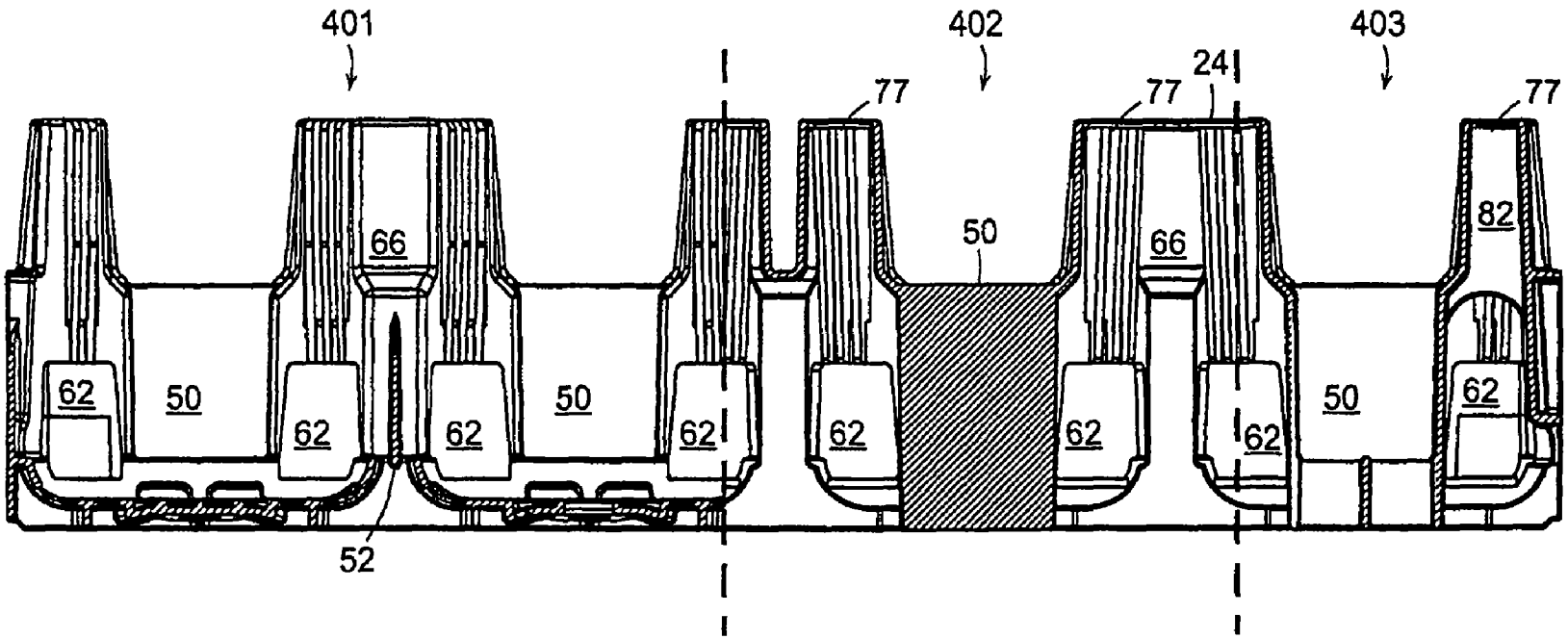
FIG. 4 is a cross-sectional view in a longitudinal direction of the bottle crate of FIG. 1.
Figure 7:
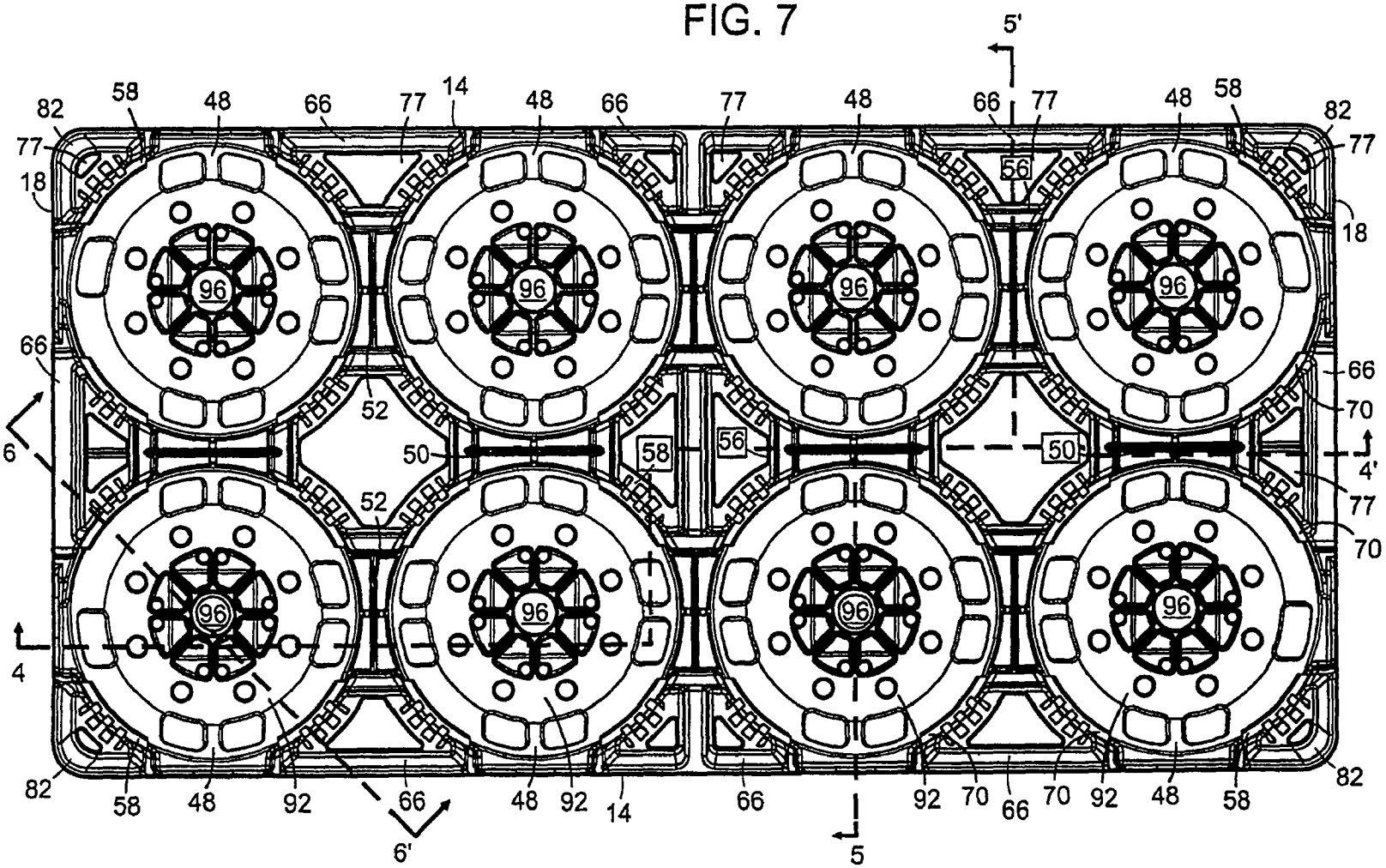
FIG. 7 is a top plan view of the bottle crate of FIG. 1.

FIG. 4 is a cross-sectional view of the bottle crate of FIG. 1 at 4-4' (see FIG. 7). In portion 401 of FIG. 4, a partition 52 is shown to provide support to a column 66 towards the bottom portion of the column 66. In portion 402 of FIG. 4, a partition 50 is shown to provide support to two columns 66. Additionally, cut-outs 77 are shown on the top surface of the columns 66. In portion 403 of FIG. 4, a column 82 is shown with a cut-out 77 on the top surface of the column 82.

Figure 5:
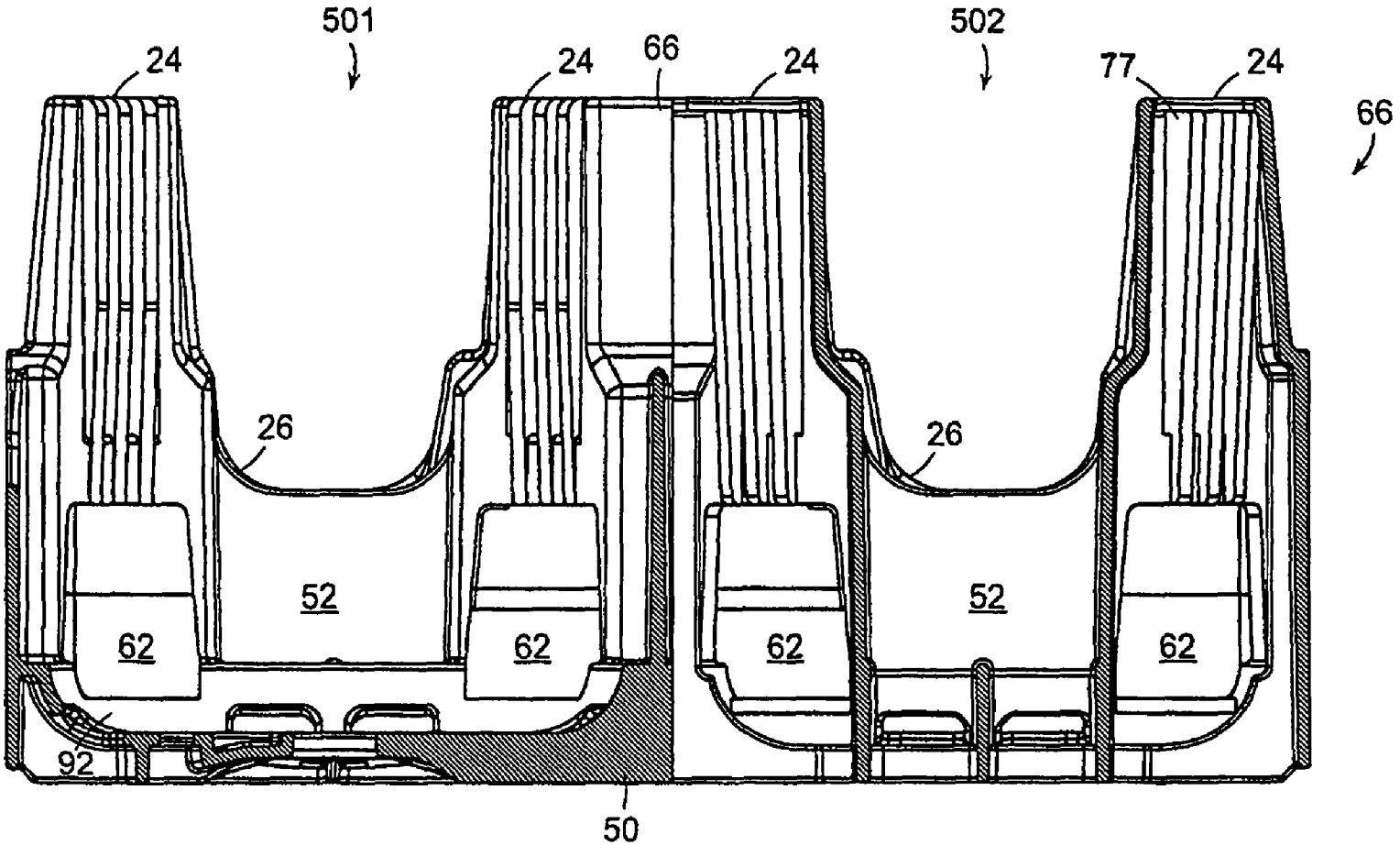
FIG. 5 is a cross-sectional view in a transverse direction of the bottle crate of FIG. 1.

FIG. 5 is a cross-sectional view of the bottle crate of FIG. 1 at 5-5' (see FIG. 7). In portion 501 of FIG. 5, a partition 50 is shown to connect to a column 66 and to a bottle supporting platform 92. In portion 502 of FIG. 5, a cut-out 77 is shown on the top surface of a column 66.

Figure 6:
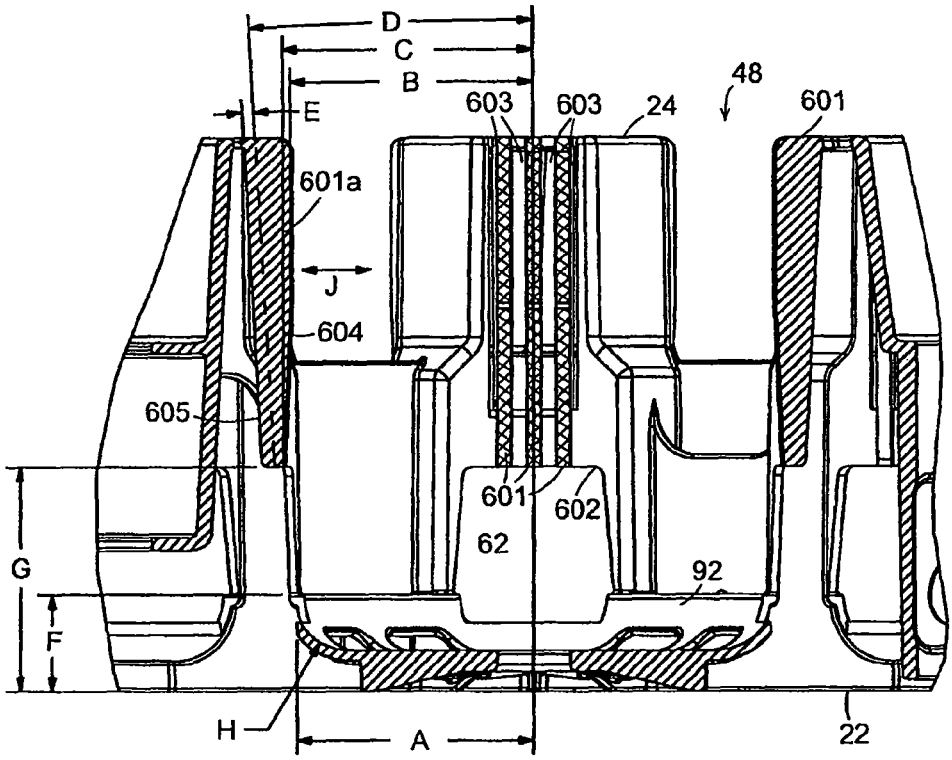
FIG. 6 is an elevation view of a bottle receiving pocket of the bottle crate of FIG. 1.

FIG. 6 is a cross-sectional view of the bottle crate of FIG. 1 at 6-6' (see FIG. 7). Three of the four walls of a bottle receiving pocket 48 are shown in FIG. 6. The wall on the left in FIG. 6 shows that the bottom of the pocket provides a space to accommodate a bottle. The bottom of the pockets provides bottle supporting platform 92 having a radius A and a curved transition wall that connects the bottle supporting platform 92 to the vertical wall of the pocket 48 having a curvature H to accommodate the bottom of a bottle. For example, for a crate accommodating 2-liter bottles, the radius A can be approximately 2.073 inches and the curvature can have a cross-sectional radius of 0.5 inches. Alternatively, the radius A and the curvature can have different dimensions if the crate is configured to accommodate bottles of a different size. Further, the radius A can be in a range of approximately 1.9 to 2.1 inches, where 2.073 inches is one suitable value, and the curvature can be in a range of approximately 0.4 to 0.6 inches, where 0.5 inches is one suitable value.

Each wall preferably includes a cut-out 602 from approximately the top of the bottle supporting platform 92 to approximately a height of G above the bottom surface 22 of the crate 10 and creates an opening 62 under the respective column. For a crate accommodating 2-liter bottles, G preferably is approximate 2 inches from the bottom surface 22. Each wall extends from the top of the bottle supporting platform, which is at a height of F from the bottom surface 22 to the top surface 24 of the crate. For a crate accommodating 2-liter bottles, F preferably can be in a range of approximately 0.8 to 0.9 inches, where one suitable value is 0.86 inches from the bottom surface 22.

Each of the walls 58 and 70 includes one or more elastically arranged fingers that are vertically disposed above the cut-out 602. Each finger 601 may be formed either integrally with same material of construction for crate 10, or a different material. As shown in FIG. 6, the fingers project upwardly from the top of the cut-out 602. Each finger 601 can be arranged by forming a plurality of vertical cuts 603 in the walls of interior columns 54, half columns 66, or corner columns 82. For example, four vertical cuts 603 can be formed on each wall to provide three fingers. Also, for each column arranged with one or more fingers, a cut-out 77 preferably is provided on top of the column (see FIG. 7). The cut-outs 77 provide each column and their bottle supporting surfaces with additional flexibility. For example, as a bottle is being received into a bottle receiving pocket 48, a cut-out 77 on a wall 58 or 70 allows the wall and its fingers to flex away from the bottle receiving pocket.

The left side of FIG. 6 shows a cross-sectional view of a finger 601*a* formed on a wall perpendicular to a second walls (having three fingers), which is shown approximately in the center of FIG. 6. The top of finger 601*a* is formed at a distance B from the center of the bottle receiving pocket 48 and bottom of the finger 601*a* is formed at a distance C from the center of the bottle receiving pocket 48. For a bottle receiving pocket formed to accommodate a 2-liter bottle, the distance C can be approximately 2.195 inches and distance B can be approximately 2.130 inches. The distance from the top of the finger to the center of the bottle receiving pocket 48 is slightly smaller than the distance from the bottom of the finger to the center of the bottle receiving pocket 48. In this configuration, the finger impedes a bottle with a variable diameter received in the bottle receiving pocket 48. Additionally, the finger 601*a* has a thickness denoted by E. For a bottle receiving pocket formed to accommodate a 2-liter bottle, the thickness E preferably can be approximately 0.1 inches.

The finger 601*a* preferably has a surface 604 facing towards the bottle receiving pocket 48 that is gradually tapered toward the bottom of the finger 601*a*. In this configuration, when a bottle is being received into the bottle receiving pocket 48, the bottle makes contact with finger 601*a* and the finger 601*a* flexes to allow a portion of the bottle with the largest diameter near the bottom of the bottle to pass towards the bottle supporting platform 92. The gradually tapered surface 604 allows the finger 601*a* to return to its unflexed position gradually as the largest portion of the bottle passes. Once the bottle is fully received into the bottle receiving pocket 48 and supported by the bottle supporting surface 92, the finger 601*a*, along with other fingers 601, makes contact with a portion of the bottle having a smaller diameter than the largest portion of the bottle near the bottom of the bottle and hold the bottle in an upright orientation. Additionally, the fingers 601 impedes the bottle from moving out of the bottle receiving pocket 48. Similarly, when a bottle is being removed from the bottle receiving pocket, the tapered surface gradually flexes the finger 601*a* and allows the largest of portion of the bottle pass out of the pocket 48.

The finger 601*a* preferably also has a surface 605 facing away from the bottle receiving pocket 58 such that the finger 601*a* narrows in width towards the bottom denoted by angle D. To accommodate 2-liter bottles, this angle D preferably is approximately 3 degrees. In this configuration, the narrowing width, the cut-outs 603 and 77 together provide an elasticity to the finger 601*a* in the direction J towards and away from the center of the bottle receiving pocket 48 and finger 601*a* elastically supports a bottle received in the bottle receiving pocket 48.

Figure 6A:
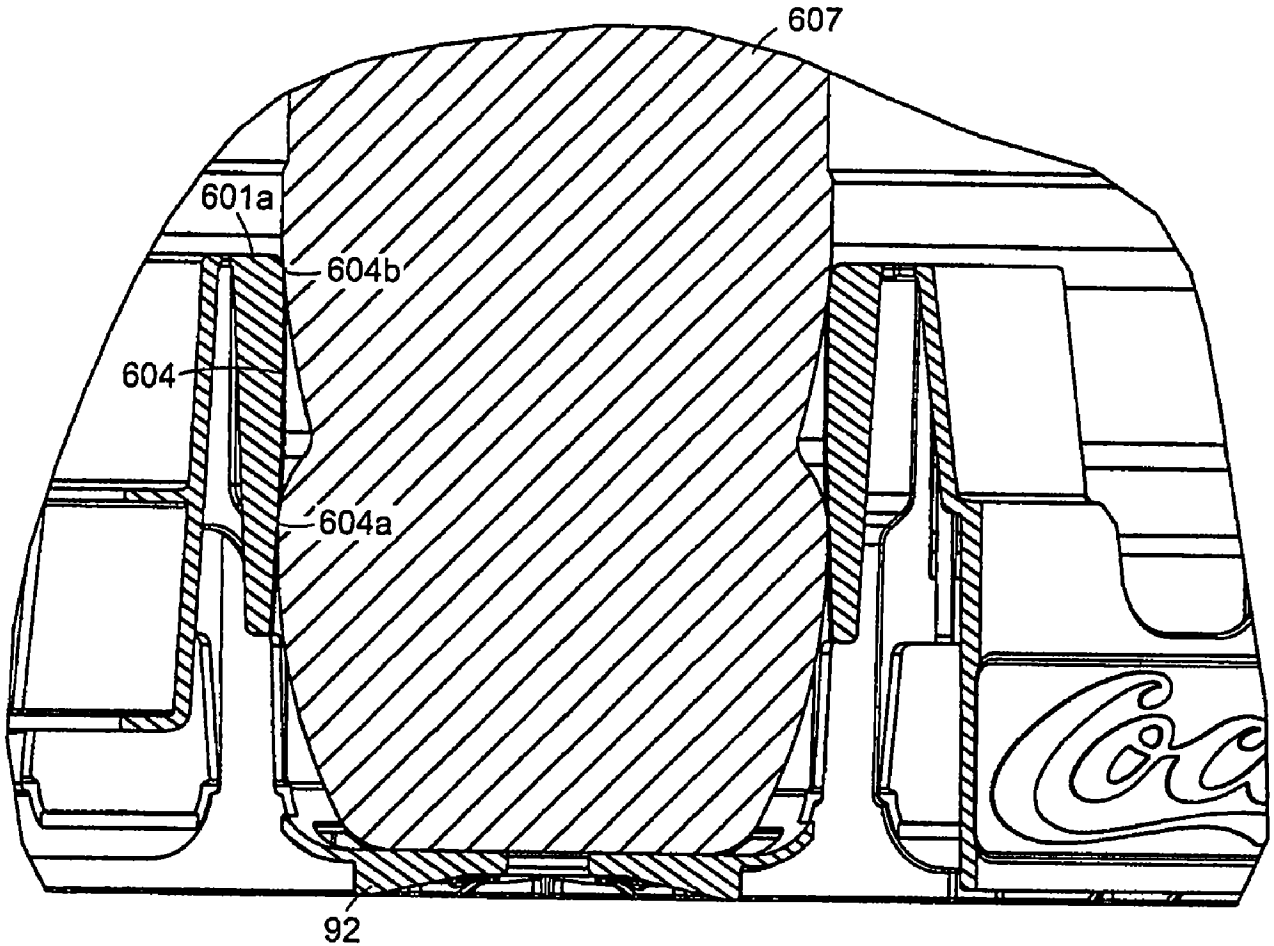
FIG. 6A is a partial elevation view of a bottle received in the bottle receiving pocket of FIG. 6.

FIG. 6A shows a partial view of a bottle 607 being received in the bottle receiving pocket of FIG. 6. A surface 604 of the finger 601*a* makes contact with the bottle 607 at approximately locations 604*a* and 604*b*. A first portion of the bottle 607 makes contact with the surface 604 at location 604*a*. A second portion of the bottle 607 makes contact with the surface 604 at 604*b* has a smaller diameter than the first portion of the bottle. The finger 601*a* is able to make contact with the bottle at both locations 604*a* and 604*b* since 604*a* corresponds to a location on the finger 601*a* that is tapered such that the larger diameter of the first portion of the bottle is accommodated.

As shown in FIG. 6A, the finger 601*a* makes contact with the bottle 607 at both the first and second portions of the bottle. It will be appreciated that the finger may make contact with the second portion of the bottle only in another embodiment. Also, it will be appreciated that the finger may make contact with any second portion of the bottle that has a diameter smaller than the first portion as long as the second portion of the bottle is above the first portion of the bottle once the bottle is received in the bottle receiving pocket.

Figure 8:
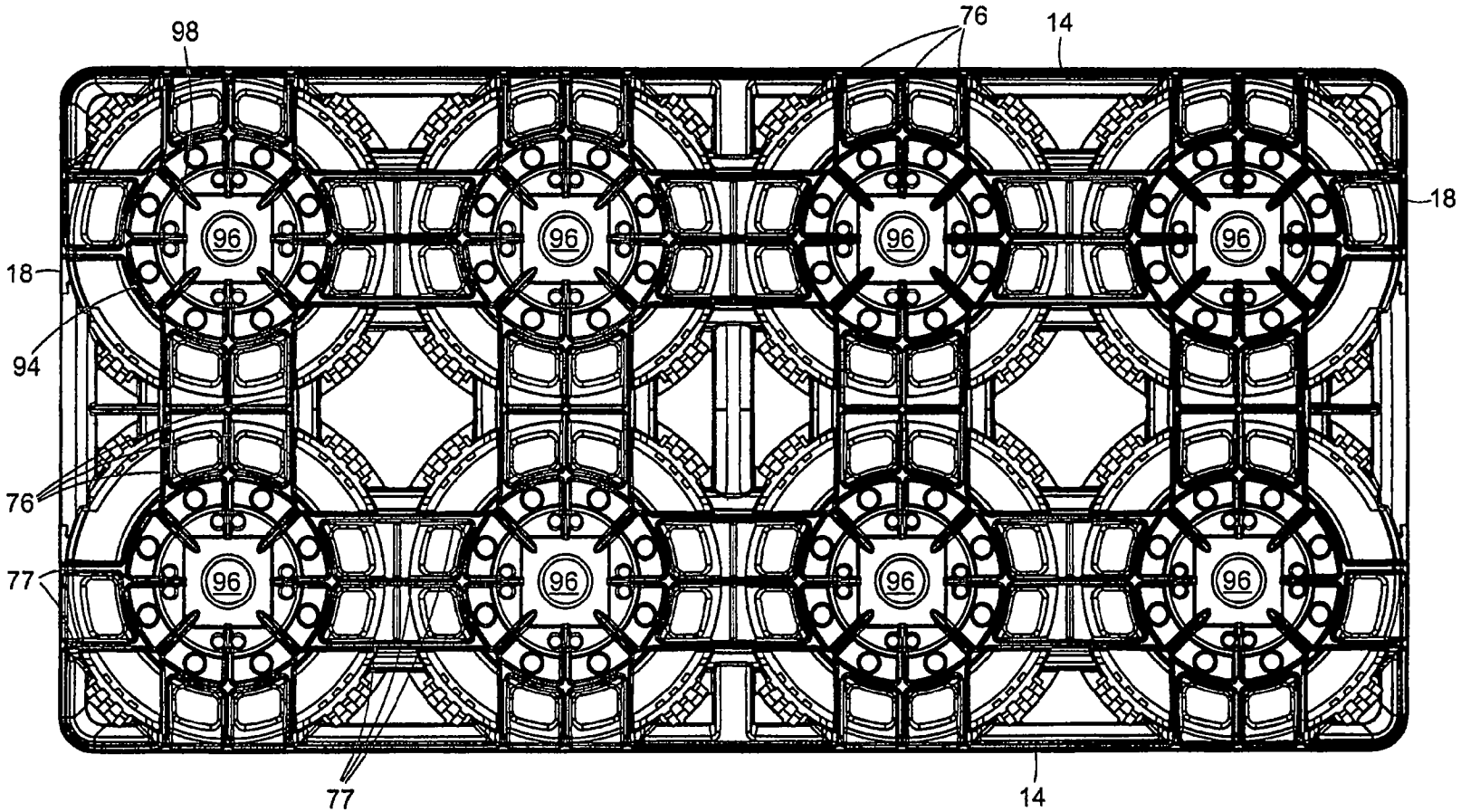
FIG. 8 is a bottom plan view of the bottle crate of FIG. 1.

With reference also to FIGS. 7 and 8, within each bottle receiving pocket 48, the crate bottom is formed to include a corresponding 2-liter bottle supporting platform 92. The crate bottom 22 is a grid-like structure integrally connected to the lower edge of the crate peripheral wall 12. The connection between the crate bottom and the peripheral wall 12 is strengthened by the additional ribs or gussets 76, 77 that are run in longitudinally or traversal directions and either connects peripheral wall 12 to a bottle supporting bottom 92 or connects two bottle supporting bottoms 92.

Connected to the ribs 76 and 77 are rings 94 that supports the individual bottle support platforms 92. Tapered radial ribs 98 extend from the rings 94 towards and further supports the center of the bottle support platform 92.

Figure 8A:
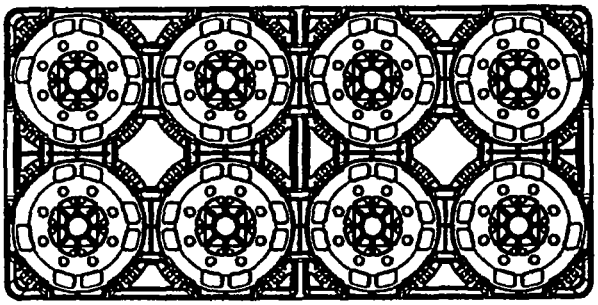
FIGS. 8A-8C are views of an empty bottle crate stacked on top of a full bottle crate.
Figure 8B:
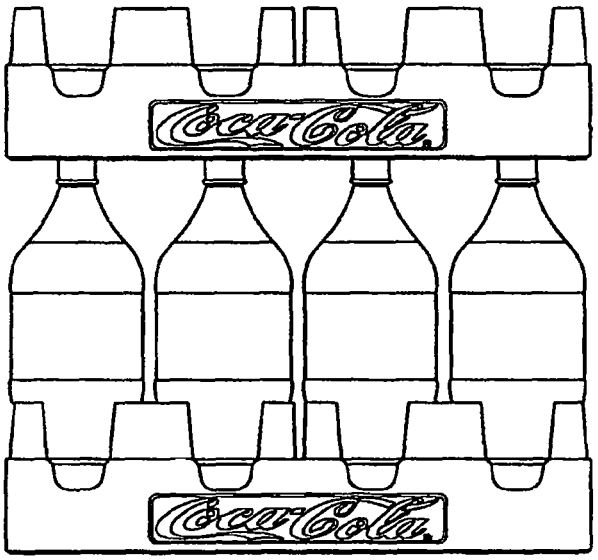
Figure 8C:
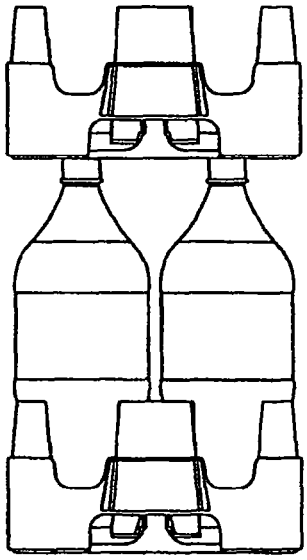

The surface of the crate bottom substantially mirrors the top surface in FIGS. 7 and 8 respectively. On each bottle support platform 92 a center hole 96 is formed about the center of the bottle support platform so that when a first crate is substantially full of bottles, a second crate may be stacked on top of the first crate and the center holes 96 of the bottle support platforms 92 substantially line up with the bottle tops of the bottles in the first crate (see FIGS. 8A-8C).

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications and other references cited herein are hereby expressly incorporated herein in their entireties by reference.

What is claimed is:

1. A bottle crate, comprising:

at least one tray having a plurality of bottle receiving pockets configured to receive a plurality of bottles, each bottle receiving pocket having a center and a plurality of walls;

a plurality of upwardly projecting fingers elastically arranged on at least one of the plurality of walls in each bottle receiving pocket of the at least one tray, the fingers being positioned over a cut-out in a lower portion of the at least one wall and movable in response to insertion or removal of at least one bottle of the plurality of bottles, each of the fingers in each plurality of fingers are connected together at a bottom end above the cut-out and at a top end and being separated by an aperture between each finger, each finger including a top formed at a first distance from the center of the bottle receiving pocket and a bottom formed at a second distance from the center of the bottle receiving pocket greater than the first distance.

2. The bottle crate of claim 1, wherein the at least one tray is stackable with one or more additional trays.

3. The bottle crate of claim 1, wherein the aperture is a generally rectangular opening.

4. The bottle crate of claim 1, wherein the at least one bottle has a variable diameter.

5. The bottle crate of claim 1, wherein each finger has a gradually tapered surface from the top of the finger to the bottom of the finger, the gradually tapered surface facing the bottle receiving pocket.

6. The bottle crate of claim 1, wherein each finger extends outward from the at least one wall.

7. The bottle crate of claim 1, further comprising a plurality of bottle supporting platforms corresponding to the plurality of bottle receiving pockets for supporting the plurality of bottles received in the bottle crate.

8. The bottle crate of claim 7, wherein the plurality of bottles are held in an upright orientation in the bottle crate.

9. The bottle crate of claim 7, wherein the plurality of fingers are arranged to reduce a diameter of each of the bottle receiving pockets.

10. A method for holding bottles in a bottle crate, comprising the steps of:

providing at least one tray having a plurality of receiving pockets configured to receive a plurality of bottles, each receiving pocket including a plurality of fingers, each finger separated by an aperture and elastically arranged to include a top portion at a first distance from a center of the receiving pocket and a bottom portion at a second distance from the center of the receiving pocket greater than the first distance over a cut-out on the at least one tray;

arranging at least one bottle of the plurality of bottles on the bottle crate, such that insertion or removal of the bottle results in movement of at least one of the plurality of fingers; and holding the at least one bottle in an upright orientation in the bottle crate.

11. The method of claim 10, wherein the plurality of fingers are arranged on wall sections of the at least one tray.

12. The method of claim 10, further comprising the step of:

receiving the at least one bottle in a bottle receiving pocket of the bottle crate, the bottle receiving pocket being defined by a plurality of walls.

13. The method of claim 10, further comprising the step of:

stacking the at least one tray with one or more additional trays.

14. A bottle crate, comprising:

a tray having a plurality of bottle receiving pockets configured to receive a plurality of bottles, the tray including a plurality of columns arranged about an outer wall of the tray;

a plurality of fingers elastically arranged in at least one of the plurality of receiving pockets on the tray, the fingers connected at a bottom end and at a top end and having an aperture between each finger, and being movable in response to insertion or removal of at least one bottle of the plurality of bottles, each finger including a top formed at a first distance from a center of respective bottle receiving pocket and a bottom formed at a second distance from the center of the respective bottle receiving pocket greater than the first distance.

15. The bottle crate of claim 14 wherein the plurality of fingers project upwardly.

16. The bottle crate of claim 14 wherein the tray is plastic.

17. The bottle crate of claim 14 further comprising a first end wall at one end of the tray and an opposing second end wall at a second end of the tray.

18. The bottle of crate of claim 17 further comprising a first handle opening in the first end wall, and a second handle opening in the second end wall.

19. The bottle crate of claim 14 wherein the plurality of elastically arranged fingers are disposed above a cut-out in the tray.

20. The bottle crate of claim 1 wherein the first distance is approximately 2.195 inches.

21. The bottle crate of claim 20 wherein the second distance is approximately 2.130 inches.

22. The bottle crate of claim 1 wherein each finger includes a surface facing away from the bottle receiving pocket such that the finger narrows in width towards a bottom of the finger at a first angle.

23. The bottle crate of claim 22 wherein the first angle is approximately three degrees.

* * * * *